US006665515B2

(12) United States Patent
Lee

(10) Patent No.: US 6,665,515 B2
(45) Date of Patent: Dec. 16, 2003

(54) FUSING DEVICE FOR ELECTROPHOTOGRAPHIC IMAGE FORMING APPARATUS

(75) Inventor: Kyung-woo Lee, Suwon-si (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 55 days.

(21) Appl. No.: 10/091,521

(22) Filed: Mar. 7, 2002

(65) Prior Publication Data

US 2003/0039493 A1 Feb. 27, 2003

(30) Foreign Application Priority Data

Aug. 25, 2001 (KR) ..... 2001-51583

(51) Int. Cl.[7] ..... G03G 15/20
(52) U.S. Cl. ..... 399/330; 219/216
(58) Field of Search ..... 399/330, 333; 218/216

(56) References Cited

U.S. PATENT DOCUMENTS

2002/0118984 A1 8/2002 Lee et al.
2002/0118985 A1 8/2002 Lee
2002/0176720 A1 * 11/2002 Lee et al. ..... 399/88

FOREIGN PATENT DOCUMENTS

DE 3817935 A1 12/1988
EP 1217466 A1 6/2002
WO WO98/31194 7/1998

OTHER PUBLICATIONS

Search Report Issued Feb. 12, 2002 by the European Patent Office on Corresponding co–pending U.S. patent application No. 10/091,521 filed on the Mar. 7th 2002.

* cited by examiner

*Primary Examiner*—Quana M. Grainger
(74) *Attorney, Agent, or Firm*—Robert E. Bushnell, Esq.

(57) ABSTRACT

A fusing device for an electrophotographic image forming apparatus includes: a heat pipe having a tubular shape and containing a predetermined amount of a working fluid, the heat pipe being hermetically sealed at both of its ends; a fusing roller surrounding the heat pipe; a heater installed between the fusing roller and the heat pipe for generating heat; and a power connecting unit for transmitting external electric power to the heater. The heater includes: a resistive coil for generating heat using the electric power transmitted by the power connecting unit, the resistive coil not being covered with a protective coating layer; a first insulation layer providedon the inside of the fusing roller so as to contact the resistive coil; a second insulation layer provided on the outside of the heat pipe so as to contact the resistive coil; and leads for connecting the resistive coil to the power connecting unit at both ends of the heater. Accordingly, the fusing roller uses the heat pipe, thereby reducing warming-up time for initial operation. Since the resistive coil is covered with the insulation layer, the heater can be easily manufactured. In addition, use of a heat sink and an insulation layer secures the reliability of the leads in the heater and end caps.

23 Claims, 8 Drawing Sheets

FUSING DEVICE FOR ELECTROPHOTOGRAPHIC IMAGE FORMING APPARATUS

CLAIM OF PRIORITY

This application makes reference to, incorporates the same herein, and claims all benefits accruing under 35 U.S.C. §119 from my application FUSING DEVICE OF ELECTROPHOTOGRAPHIC IMAGE FORMING APPARATUS filed with the Korean Intellectual Property Office on Aug. 25, 2001 and there duly assigned Serial No. 51583/2001, which was subsequently published on the Mar. 4, 2003 as Publication No. 2003-17940 by the Korean Intellectual Property Office.

BACKGROUND OF THE INVENTION

1. Technical Field

The present invention relates to a fusing device for an electrophotographic image forming apparatus and, more particularly, to a fusing device using a heat pipe to decrease power consumption and allow flash heating in an electrophotographic image forming apparatus.

2. Related Art

Electrophotographic image forming apparatuses include a fusing device for heating a sheet, to which a toner image is transferred, to fuse and fix the toner image in a powder state to the sheet. The fusing device includes a fusing roller for fusing and fixing a toner to a sheet and a pressing roller for pressing the sheet against the fusing roller.

A fusing roller unit includes a cylindrical fusing roller and a halogen lamp installed inside the fusing roller and along its axis. A Teflon coating layer is formed on the surface of the fusing roller. The halogen lamp generates heat within the fusing roller, and the fusing roller is heated by the radiant heat emitted from the halogen lamp.

A pressing roller is disposed below the fusing roller unit and in contact with the fusing roller such that a sheet passes therebetween. The pressing roller is elastically supported by a spring so that it makes the sheet closely contact the fusing roller with a predetermined pressure when the sheet passes between the fusing roller and the pressing roller. A toner image formed on the sheet in a powder state is fused and fixed to the sheet by predetermined pressure and heat when the sheet passes between the fusing roller and the pressing roller.

A thermistor for measuring the surface temperature of the fusing roller and a thermostat for cutting off the supply of power when the surface temperature of the fusing roller exceeds a predetermined set value are provided at one side of the fusing roller. The thermistor measures the surface temperature of the fusing roller and transmits an electric signal corresponding to the measured temperature to a controller of a printer. The controller controls the quantity of electricity supplied to the halogen lamp according to the measured temperature so as to maintain the surface temperature of the fusing roller within a predetermined range. When the temperature of the fusing roller exceeds the predetermined set value because the thermistor and the controller fail to control the temperature of the fusing roller, a contact of the thermostat opens so as to cut off the supply of power to the halogen lamp.

Such a fusing device using a halogen lamp as a heat source consumes a large amount of electric power. Particularly, when power is turned on, the device requires quite a long warming-up time. The warming-up time may range from several tens of seconds to several minutes. In addition, in such a fusing device, since the fusing roller is heated by radiation emitted from a heat source, heat transmission is slow, and compensation for temperature deviation caused by a decrease in temperature occurring due to contact with a sheet is slow. Thus, it is difficult to maintain the temperature of the fusing roller constant. Moreover, since electric power must be periodically applied to the heat source in order to maintain the temperature of the fusing roller constant in a standby mode in which the operation of the printer is in a pause state, unnecessary electric power is consumed.

SUMMARY OF THE INVENTION

To solve the above-described problems, it is an object of the present invention to provide a fusing device which includes a power connecting unit which has improved durability and reliability and which decreases a warming-up time at initial operation or at transition from a standby mode to re-operation in an electrophotographic image forming apparatus.

To achieve the above object of the invention, there is provided a fusing device for an electrophotographic image forming apparatus. The fusing device includes: a heat pipe having a tubular shape and containing a predetermined amount of working fluid, the heat pipe being hermetically sealed at both of its ends; a fusing roller surrounding the heat pipe; a heater installed between the fusing roller and the heat pipe for generating heat; and a power connecting unit for transmitting external electric power to the heater. The heater includes: a resistive coil for generating heat using the electric power transmitted by the power connecting unit, the resistive coil not being covered with a protective coating layer; a first insulation layer provided on the inside of the fusing roller so as to contact the resistive coil; a second insulation layer provided on the outside of the heat pipe so as to contact the resistive coil; and leads for connecting the resistive coil to the power connecting unit at both ends of the heater.

Preferably, each of the first and second insulation layers is formed of at least one mica layer.

Preferably, the power connecting unit includes an electrode inserted into an outer end portion of each of first and second end caps which are installed at both ends of, and on the axis of rotation of, the fusing roller, a brush installed in a through hole formed in a frame supporting the fusing roller so as to contact the electrode, and an elastic unit for making the brush closely contact the electrode for electrical connection.

Preferably, each of the first and second end caps includes a lead hole formed in a lengthwise direction so as to allow each lead to pass therethrough, a bottom portion formed so as to allow the lead passing through the lead hole to be electrically connected to the electrode which is inserted into the corresponding end cap, a first insulation film provided on the bottom portion of each of the first and second end caps so as to isolate the bottom portion from the lead, and a heat sink provided on the first insulation film and electrically connected to the lead.

Preferably, the fusing device further includes a second insulation film formed in the lead hole of each of the first and second end caps for isolating the lead from the lead hole.

Preferably, the fusing device further includes: at least one key formed at a portion of an outer circumference of each end cap, the latter portion engaging an end of the fusing roller; and at least one key way formed at each end of the fusing roller so as to correspond to the key. The key way(s) is (are) formed at the inner side of each end of the fusing roller to be recessed.

Preferably, each of the leads includes a ring electrically connected to the resistive coil at each end of the heater, and a string extending from the ring.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference numerals indicate the same or similar components, and wherein.

DETAILED DESCRIPTION OF THE INVENTION

Figure 1:
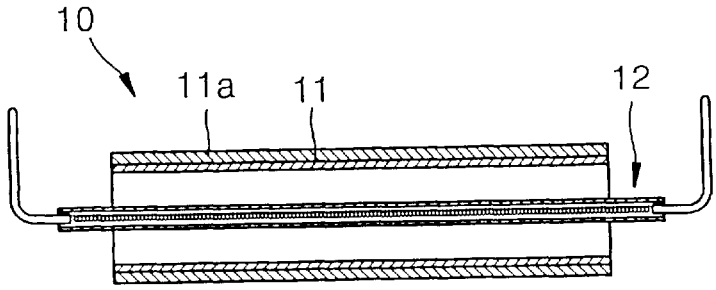
FIG. 1 is a schematic horizontal sectional view of a fusing roller unit using a halogen lamp as a heat source.

Hereinafter, an embodiment of the present invention will be described in detail with reference to the attached drawings. In the drawings, the thickness of films or regions are exaggerated for clarity.

Figure 2:
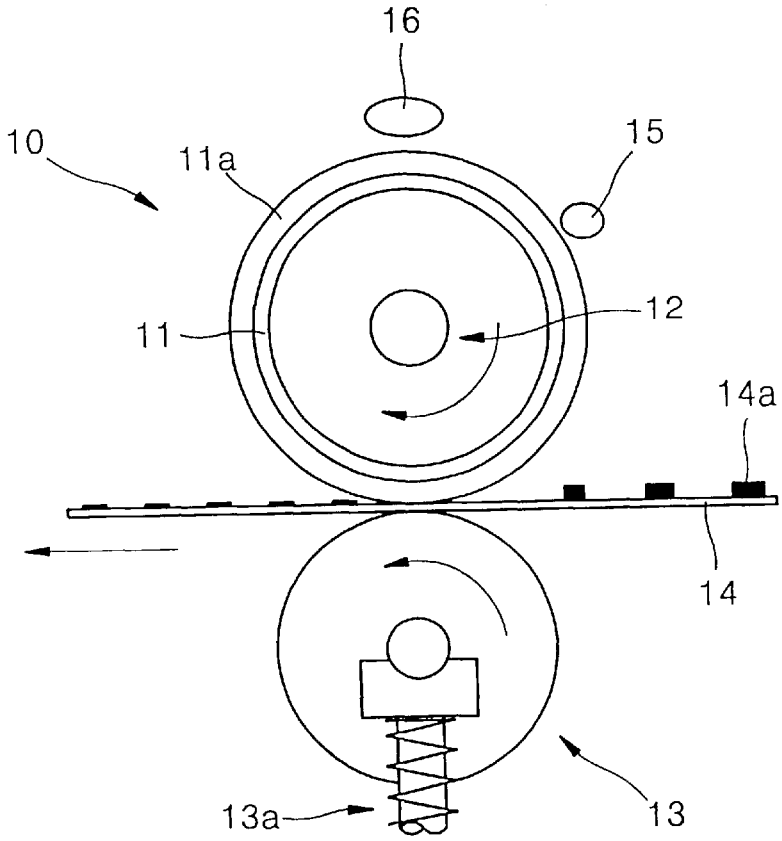
FIG. 2 is a schematic vertical sectional view of a fusing device using the fusing roller unit of FIG. 1.

FIG. 1 is a schematic horizontal sectional view of a fusing roller unit using a halogen lamp as a heat source, while FIG. 2 is a schematic vertical sectional view of a fusing device using the fusing roller unit of FIG. 1.

Referring to FIG. 1, a fusing roller unit 10 includes a cylindrical fusing roller 11 and a halogen lamp 12 installed inside the fusing roller 11 and along its axis. A Teflon coating layer 11*a* is formed on the surface of the fusing roller 11. The halogen lamp 12 generates heat within the fusing roller 11, and the fusing roller 11 is heated by the radiant heat emitted by the halogen lamp 12.

Referring to FIG. 2, a pressing roller 13 is disposed below the fusing roller unit 10 and in contact with the fusing roller 11 such that a sheet 14 passes therebetween. The pressing roller 13 is elastically supported by a spring 13*a* so that it makes the sheet 14 closely contact the fusing roller 11 with a predetermined pressure when the sheet 14 passes between the fusing roller 11 and the pressing roller 13. A toner image 14*a* formed on the sheet 14 in a powder state is fused and fixed to the sheet 14 by predetermined pressure and heat when the sheet 14 passes between the fusing roller 11 and the pressing roller 13.

A thermistor 15 for measuring the surface temperature of the fusing roller 11 and a thermostat 16 for cutting off the supply of power when the surface temperature of the fusing roller 11 exceeds a predetermined set value are provided at one side of the fusing roller 11. The thermistor 15 measures the surface temperature of the fusing roller 11 and transmits an electric signal corresponding to the measured temperature to a controller (not shown) of a printer (not shown). The controller controls the quantity of electricity supplied to the halogen lamp 12 according to the measured temperature so as to maintain the surface temperature of the fusing roller 11 within a predetermined range. When the temperature of the fusing roller 11 exceeds the predetermined set value because the thermistor 15 and the controller fail to control the temperature of the fusing roller 11, a contact (not shown) of the thermostat 16 opens so as to cut off the supply of power to the halogen lamp 12.

Such a fusing device using halogen lamp 12 as a heat source consumes a large amount of electric power. Particularly, when power is turned on, the device requires quite a long warming-up time. The warming-up time may range from several tens of seconds to several minutes. In addition, in the fusing device, since the fusing roller 11 is heated by radiation emitted from a heat source, heat transmission is slow, and compensation for a temperature deviation caused by a decrease in temperature occurring due to contact with a sheet is slow. Thus, it is difficult to maintain the temperature of the fusing roller 11 constant. Moreover, since electric power must be periodically applied to the heat source in order to maintain the temperature of the fusing roller 11 constant in a standby mode in which the operation of the printer is in a pause state, unnecessary electric power is consumed.

Figure 3:
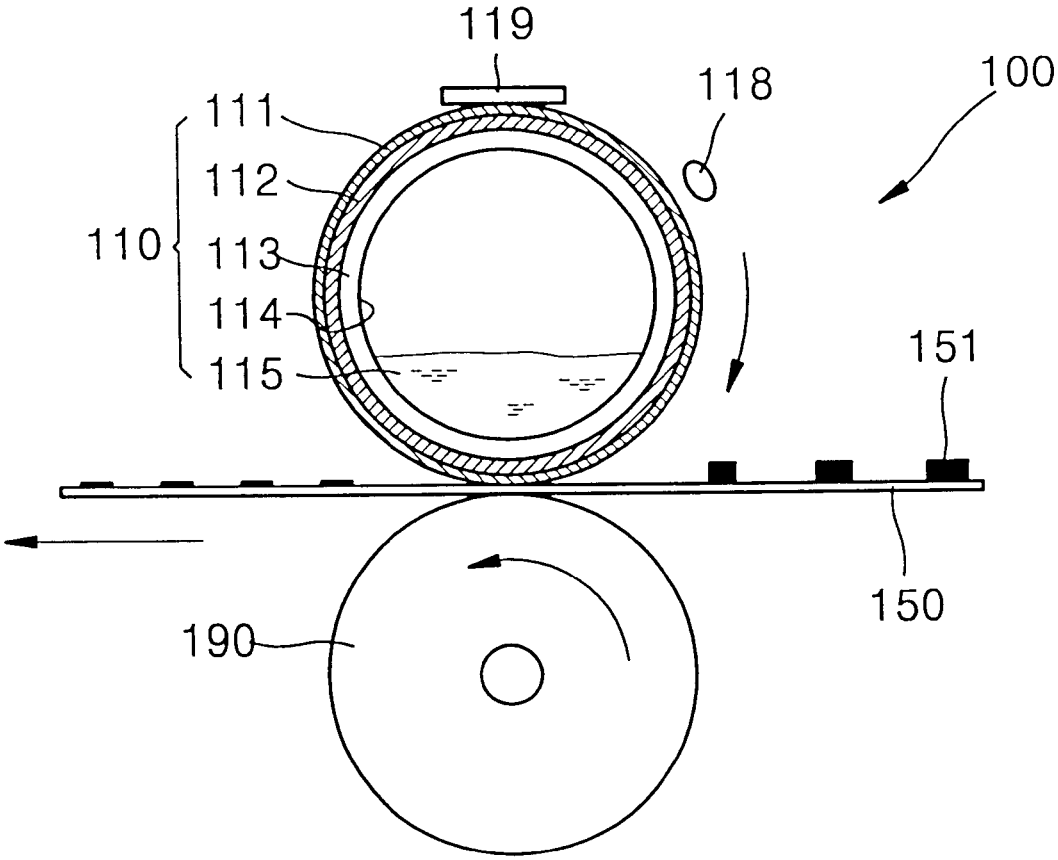
FIG. 3 is a schematic vertical sectional view of a fusing device according to a preferred embodiment of the present invention.
Figure 4:
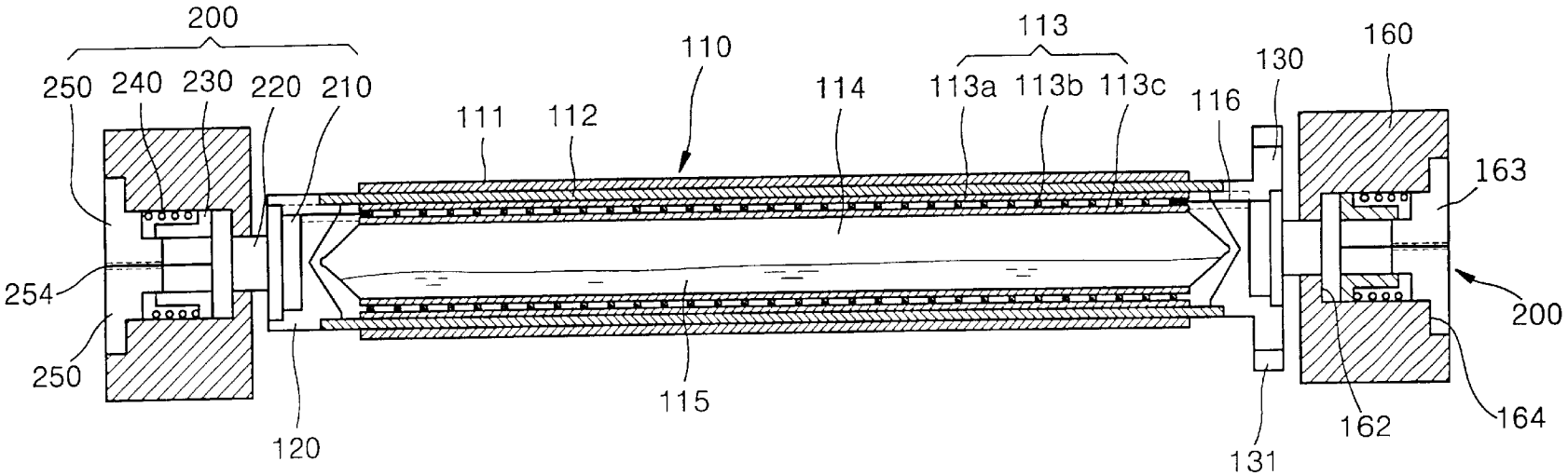
FIG. 4 is a schematic horizontal sectional view of the fusing roller shown in FIG. 3.

FIG. 3 is a schematic vertical sectional view of a fusing device, according to an embodiment of the present invention, in an electrophotographic image forming apparatus, while FIG. 4 is a schematic horizontal sectional view of the fusing roller shown in FIG. 3. Referring to FIGS. 3 and 4, a fusing device for an electrophotographic image forming apparatus according to the present invention includes a fusing roller unit 110 including a fusing roller 112 which rotates in a direction in which a sheet 150 is discharged, that is, clockwise, and a pressing roller 190 which rotates counterclockwise in contact with the fusing roller 112 such that the sheet 150 passes therebetween.

The fusing roller unit 110 also includes: cylindrical fusing roller 112, on the surface of which a coating layer 111 of Teflon coating is formed; a heater 113 which is installed within the fusing roller 112, and which is supplied with electric power from an external power supply through a power connecting unit 200; and a heat pipe 114 which is installed within the heater 113, and both ends of which are sealed hermetically to maintain a predetermined pressure. The heat pipe 114 accommodates a predetermined volume of working fluid 115. The power connecting unit 200 is installed at each end of the fusing roller 112. The power connecting unit 200 is connected to the external power supply so as to transmit electric power to the heater 113.

A thermistor 118 is installed above the fusing roller 112 so that it measures the surface temperature of the fusing roller 112 and the coating layer 111 in contact with the coating layer 111. Also, a thermostat 119 is installed above the fusing roller 112 so that it cuts off the supply of power in order to prevent overheating when the surface temperature of the fusing roller 112 and the coating layer 111 rapidly increases.

The heater 113 includes a resistive coil 113*b* formed of Ni—Cr for generating heat using electric power supplied by the power connecting unit 200, a first mica layer 113*a* disposed between the resistive coil 113*b* and the fusing roller 112, a second mica layer 113*c* disposed between the resistive coil 113*b* and the heat pipe 114, and leads 116 extending outward from both ends of the resistive coil 113*b* so as to be electrically connected to the power connecting unit 200. Each of the mica layers 113*a* and 113*c* of the heater 113 is composed of at least one layer. The resistive coil 113*b* may be formed of Cr—Fe.

In manufacturing the fusing roller unit 110 having the above structure, the heat pipe 114 is sequentially wrapped with the second mica layer 113*c*, the resistive coil 113*b*, and the first mica layer 113*a*, and is then inserted into the fusing roller 112. Next, a pressure of 100–150 atm. is applied within the heat pipe 114 to enlarge the heat pipe 114 so that the heater 113 can closely contact the outer circumferential surface of the heat pipe 114 and the inner circumferential surface of the fusing roller 112.

The heat pipe 114 has a tubular shape and is hermetically sealed at both of its ends. A predetermined amount of the working fluid 115 is contained in the heat pipe 114. The working fluid 115 evaporates due to heat generated and transmitted from the heater 113, and transmits the heat to the fusing roller 112, thereby functioning as a thermal medium which prevents a difference in the surface temperature of the fusing roller 112 and which heats the entire fusing roller 112 within a short time. The working fluid 115 occupies 5–50% of the interior volume of the heat pipe 114, and preferably 5–15% of the interior volume of the heat pipe 114. When the working fluid 115 occupies 5% or less of the interior volume of the heat pipe 114, a dry-out phenomenon is very likely to occur. Accordingly, it is preferable to avoid the above case of 5% or less.

The working fluid 115 is selected depending upon the material of the heat pipe 114. For example, when the heat pipe 114 is formed of stainless steel, most working fluids known up to now, except for water, can be used as the working fluid 115. It is most preferable to use FC-40 (3M) as the working fluid 115.

When the heat pipe 114 is formed of copper (Cu), most known working fluids can be used. It is most preferable to use water, i.e., distilled water. Using water or distilled water as the working fluid 115 has the advantages of low cost and prevention of environmental pollution.

The fusing roller 112 is heated by heat generated and transmitted by the heater 113, or by the heat of vaporization of the working fluid 115 contained in the heat pipe 114, fuses a powder-state toner 151 on the sheet 150, and fixes the toner 151 to the sheet 150. The fusing roller 112 is formed of stainless steel, aluminum (Al), or copper (Cu).

A first end cap 120 and a second end cap 130 are provided at respective ends of the fusing roller 112 so that both ends of the fusing roller 112 are covered by the first and second end caps 120 and 130, respectively. The second end cap 130 has the same structure as the first end cap 120, with the exception that the second end cap 130 is provided with a gear 131 on its outer circumferential surface such that the gear 131 of the second end cap 130 can engage a gear (not shown) of an electric motor so as to cause the second end cap 130 to rotate.

Figure 5A:
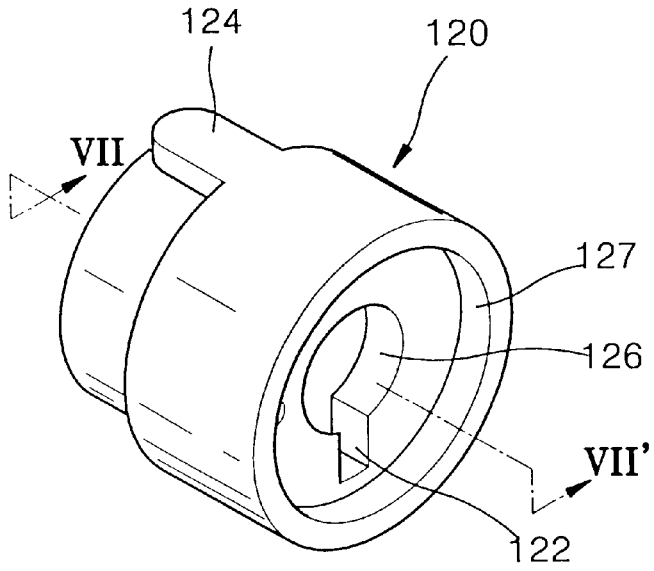
FIGS. 5A and 5B are perspective views of a first end cap shown in FIG. 4.
Figure 5B:
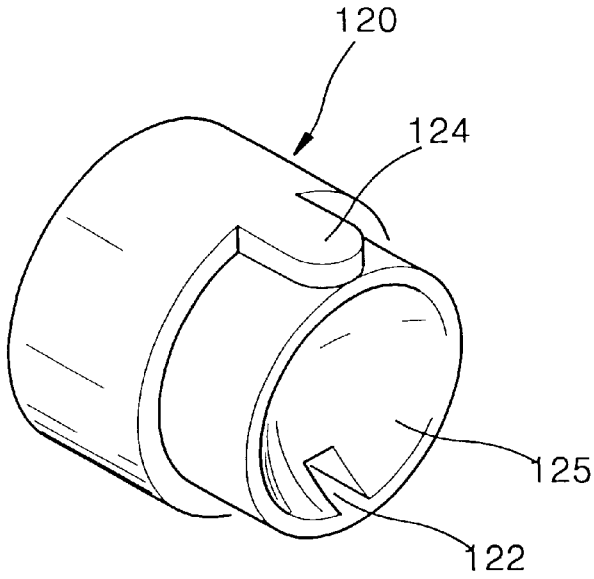
Figure 6A:
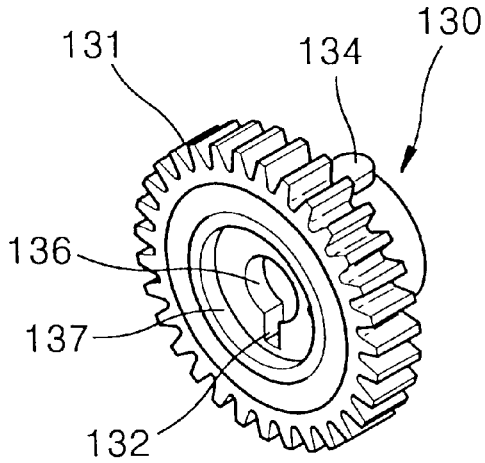
FIGS. 6A and 6B are perspective views of a second end cap shown in FIG. 4.
Figure 6B:
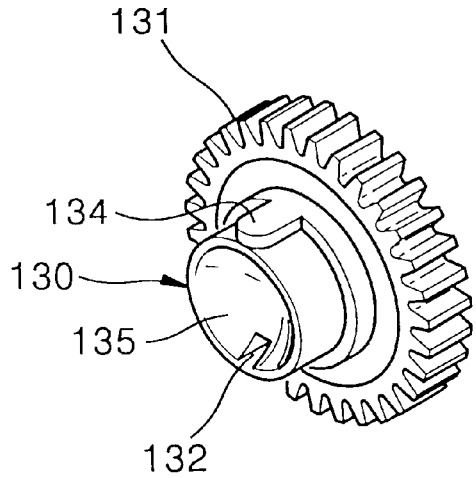
Figure 7:
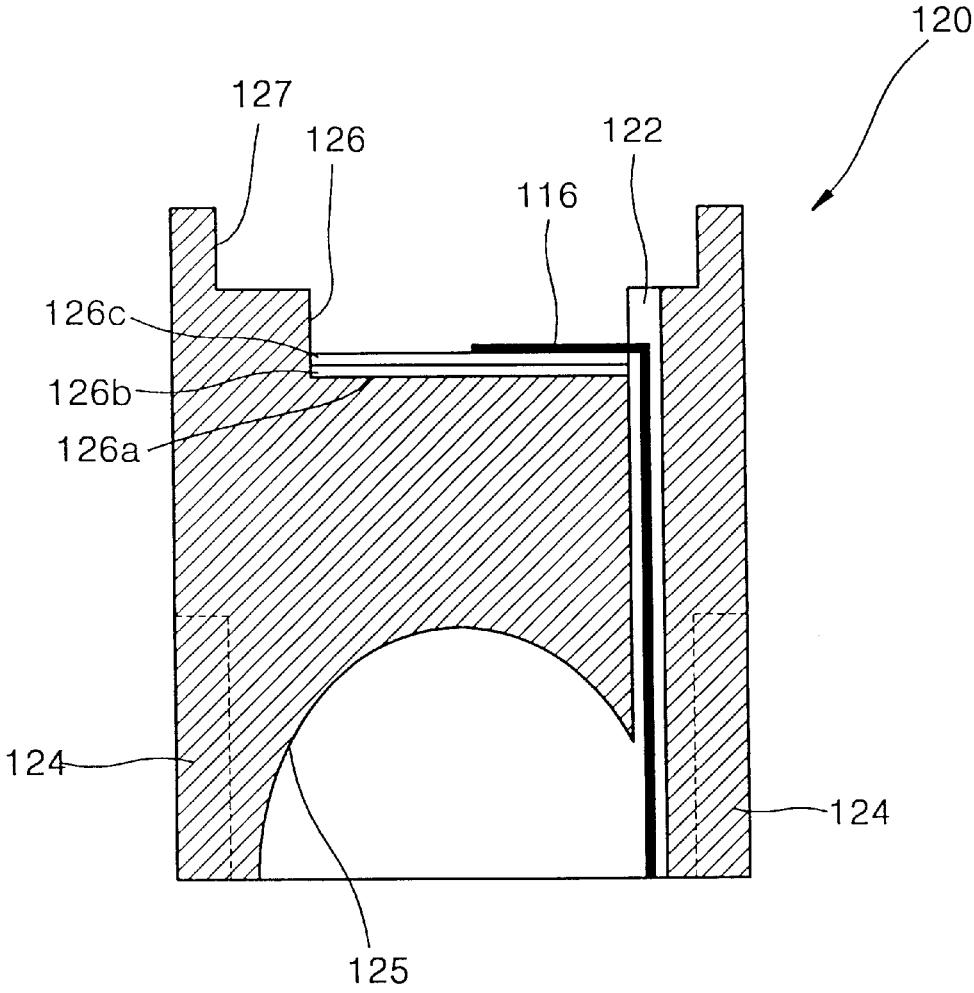
FIG. 7 is a sectional view of the first end cap of FIG. 5A, taken along the line VII-VIIN.
Figure 8:
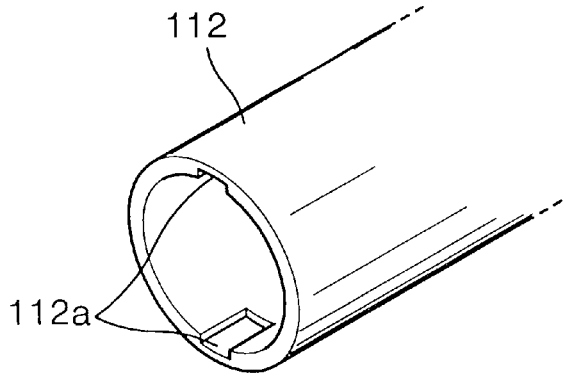
FIG. 8 is a partial perspective view of the fusing roller of FIG. 4, and shows key ways at an end of the fusing roller.

FIGS. 5A and 5B are perspective views of the first end cap 120 shown in FIG. 4; FIGS. 6A and 6B are perspective views of the second end cap 130 shown in FIG. 4; FIG. 7 is a sectional view of the first end cap 120 of FIG. 5A, taken along the line VII-VIIN (a lead 116 is illustrated together for clarity); and FIG. 8 is a partial perspective view of the fusing roller 112 of FIG. 4, and shows key ways at an end of the fusing roller 112.

Referring to FIGS. 5A thru 8, lead holes 122 and 132 are formed in the first and second end caps 120 and 130, respectively, so that a lead 116 of FIG. 7 can be introduced into each of the first and second end caps 120 and 130 in a lengthwise direction. Keys 124 and 134 are formed so as to protrude from the inner circumferences of the first and second end caps 120 and 130, respectively. The keys 124 and 134 engage key ways 112*a* of FIG. 8 formed on the inside surface of both ends of the fusing roller 112. Recesses 125 and 135 are formed at the centers of the first and second end caps 120 and 130, respectively, facing both ends of the heat pipe 114 such that both ends of the heat pipe 114 can be inserted into the recesses 125 and 135. Electrode ways 126 and 136 and electrode receiving portions 127 and 137 are formed in the outer centers opposite to the recesses 125 and 135 of the first and second end caps 120 and 130, respectively, so as to allow an electrode 210 of FIG. 4 to be inserted into each of the first and second end caps 120 and 130, respectively. The electrode way 126 is provided, on its bottom 126*a*, with a first insulation film 126*b* for preventing the heat of the lead 116 from being conducted to the first end cap 120 and a heat sink 126*c* formed on the first insulation film 126*b* so as to be connected to the lead 116, thereby radiating the heat of the lead 116. It is preferable to provide a second insulation film (not shown) on the inside of the lead hole 122 to protect the first end cap 120 from the heat of the lead 116.

Figure 9:
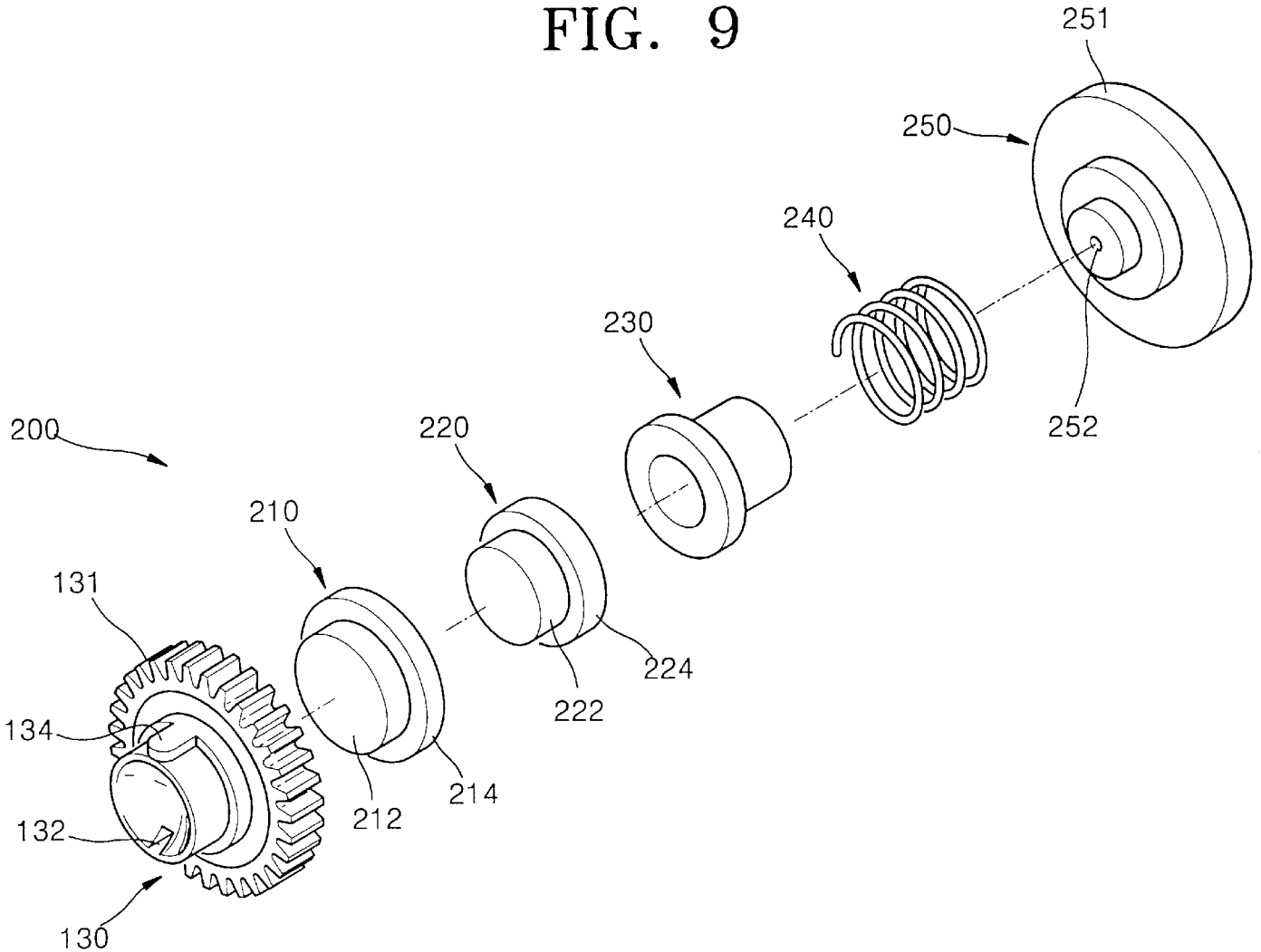
FIG. 9 is an exploded perspective view of a power connecting unit of the fusing roller of FIG. 4.

FIG. 9 is an exploded perspective view of the power connecting unit 200 connected to the second end cap 130. Referring to FIG. 9, the power connecting unit 200 is installed within a frame 160 of FIG. 4 so as to transmit external electric power to the heater 113. The power connecting unit 200 includes an electrode 210 inserted into the electrode way 136 of FIG. 6A and the electrode receiving portion 137 of FIG. 6A, a brush 220 installed so as to contact the electrode 210 in a through hole formed in the corresponding frame 160 supporting the fusing roller 112 of FIG. 4, and an elastic unit 240 to allow the brush 220 to closely contact the electrode 210 so as to be electrically connected thereto.

The electrode 210 includes: a protrusion 212 which is inserted into the electrode way 136 located at the center of the second end cap 130, i.e., on the axis of rotation of the fusing device 110; and a flange 214 integrated with the protrusion 212 and inserted into the electrode receiving portion 137. The protrusion 212 of the electrode 210 is inserted into the electrode way 136 such that the lead 116, which is inserted into the lead hole 122 of FIG. 7 and bent at a right angle, can closely contact the bottom of the electrode way 136, so that the protrusion 212 can be electrically connected to the lead 116.

The first and second end caps 120 and 130, respectively, can be formed of polyphenylene sulfide (PPS), polybutylene terephthalate (PBT), or nylon, and has a filler such as glass fiber which transforms only slightly, even at high temperature.

The brush 220 is connected to the electrode 210 so as to transmit external electric power, and is composed of a projection 222 and a plate 224. The projection 222 contacts the flange 214, and the plate 224 is connected to external lead 254 of FIG. 4.

A through hole is formed in the frame 160. A first stopper 162 and a second stopper 164 are sequentially formed in the through hole starting from its side nearer to the fusing roller 112. When the brush 220 is inserted into the through hole, the first stopper 162 stops and supports the plate 224. The second stopper 164 stops and supports a flange 251 of an insulation plate 250.

The elastic unit 240 gives elasticity to a spacer 130 so that the brush 220 closely contacts the electrode 210. In addition, the elastic unit 240 buffers transformation due to thermal expansion or contraction during repeated operation of the fusing roller 112, thereby preventing the brush 220 from being disconnected from the electrode 210. Accordingly, it is preferable to use a compression spring as the elastic unit 240. The external lead 254 of FIG. 4 is connected to the brush 220 through a lead hole 252. The lead 254 may dangerously contact the elastic unit 240, provoking a spark. Accordingly, in order to prevent this danger from occurring, and to prevent the second end cap 130 from contacting the frame 160 due to a withdrawal of the brush 220, a spacer 230 is provided.

The elastic unit 240 is installed in the frame 160 by using the insulation plate 250. The insulation plate 250 supports the elastic unit 240. Accordingly, the brush 220 is installed in the through hole of the frame 160 first, and then the elastic unit 240 and the spacer 230 are installed. Next, the insulation plate 250 is installed so as to prevent the elastic unit 240 from coming off.

The operation of a fusing device having the above-described structure in an electrophotographic image forming apparatus will be described in detail with reference to the drawings.

Once electric power is supplied to the lead 116 of the heater 113 through the external lead 254, the brush 220 and the electrode 210, the electric power provokes heat radiation from the resistive coil 113*b*. Some of the heat is transmitted to the fusing roller 112 through the first mica layer 113*a*, and the rest is transmitted to the heat pipe 114 through the second mica layer 113*c*. The working fluid 115 contained in the heat pipe 114 evaporates due to the transmitted heat. The heat of the vaporized working fluid 115 is transmitted to the fusing roller 112 through the first and second mica layers 113*a* and 113*c*, respectively, formed on the surface of the heat pipe 114. The fusing roller 112 receives the heat generated by the heater 113 and the heat of the working fluid 115 transmitted through the first and second mica layers 113*a* and 113*c* so that the surface temperature of the fusing roller 112 uniformly increases throughout the fusing roller 112 to a target temperature at which the toner 151 can be fused and fixed to the sheet 150.

Thereafter, in a printing mode, the powder-state toner 151 is transferred to the sheet 150, and is fused and fixed to the sheet 150 by the fusing roller 112 having a predetermined temperature while the sheet 150 passes between the fusing roller 112 and the pressing roller 190. Then, the heat of the fusing roller 112, which has fused and fixed the toner 151 to the sheet 150, is taken away by the sheet 150, so the working fluid 115 contained in the heat pipe 114 is liquefied. Thereafter, when heat is transmitted by the heater 113, the working fluid 115 evaporates again. Consequently, the surface temperature of the fusing roller 112 is maintained at a target temperature appropriate for fusing and fixing the toner 151 so that the printing operation can be continued.

The target temperature for normal fusing and fixing of a toner image is 160–190EC. The fusing device 100 according to the present invention reaches the target temperature within about 10 seconds. After reaching the target temperature, the thermistor 118 measures the surface temperature of the fusing roller 112 so as to maintain the surface temperature of the fusing roller 112 within a predetermined range for normal fusing and fixing of the toner 151. When the thermistor 118 fails to control the surface temperature and the surface temperature of the fusing roller 112 rapidly increases, the thermostat 119 mechanically cuts off the power of the power connecting unit 200 connected thereto, thereby preventing the surface temperature of the fusing roller 112 from rapidly increasing. Such a power supply operation can be changed depending on a setpoint of temperature. In addition, power supply can be controlled by ON/OFF control, a pulse width modulation method, or a proportional and integral (PI) method.

Figure 10:
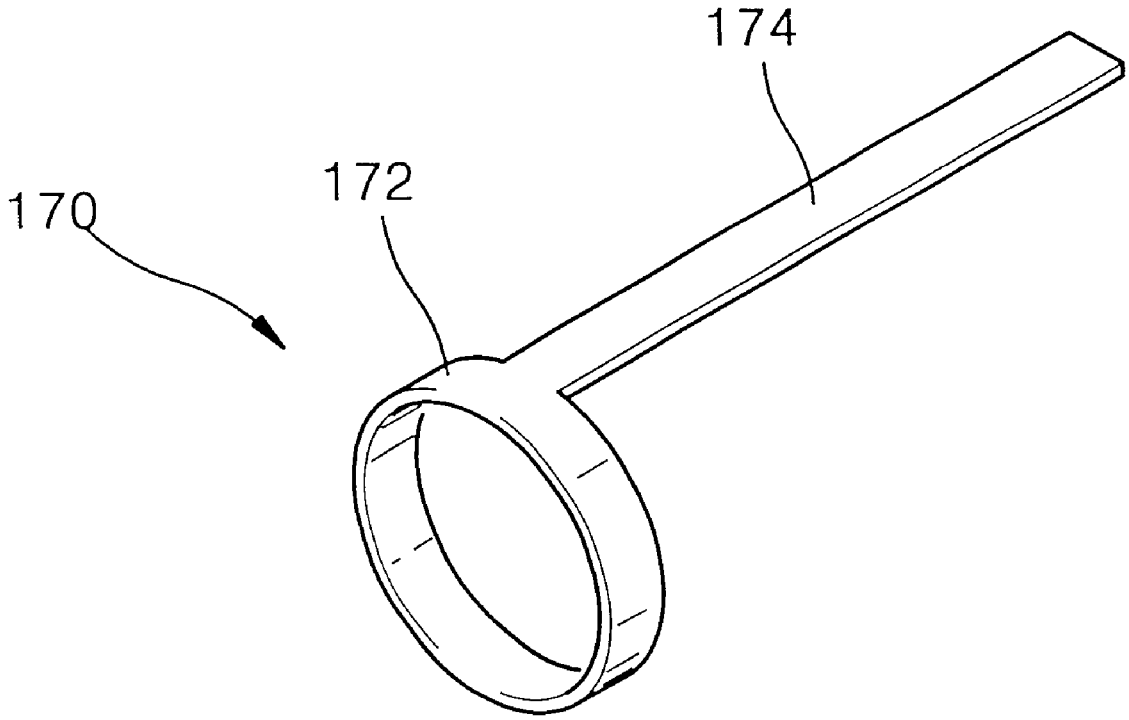
FIG. 10 is a perspective view of an example of a lead shown in FIG. 4.

FIG. 10 is a perspective view of an example of the lead shown in FIG. 4. Lead 170 is composed of a ring 172, which surrounds the heat pipe 114, and one side of which is electrically connected to an end of the resistive coil 113*b*, and a string 174 extending from the ring 172. The string 174 passes through the lead hole 122 of FIG. 7, and is connected to the electrode 210 of FIG. 9. By using the lead 170, breaking of the lead due to heat radiation from the lead in the air can be prevented, thereby more reliably connecting the electrode 210 to the heater 113.

As described above, a fusing roller for an electrophotographic image forming apparatus according to the present invention uses a heat pipe, thereby reducing warming-up time for initial operation. Since a resistive coil is covered with an insulation layer, a heater can be easily manufactured. In addition, use of a heat sink and an insulation layer secures the reliability of the leads in the heater and end caps.

Although the preferred embodiments of the present invention have been described, it will be understood by those skilled in the art that the present invention should not be limited to the described preferred embodiment. Rather, various changes and modifications can be made within the spirit and scope of the present invention, as defined by the following claims.

What is claimed is:

1. A fusing device for an electrophotographic image forming apparatus, the fusing device comprising:

a heat pipe having a tubular shape and two ends, and containing a predetermined amount of working fluid, the heat pipe being hermetically sealed at both of said ends;

a fusing roller surrounding the heat pipe;

a heater installed between the fusing roller and the heat pipe for generating heat; and a power connecting unit for transmitting external electric power to the heater;

wherein the heater comprises:

a resistive coil for generating heat using the electric power transmitted by the power connecting unit, the resistive coil not being covered with a protective coating layer;

a first insulation layer provided on the inside of the fusing roller so as to contact the resistive coil;

a second insulation layer provided on the outside of the heat pipe so as to contact the resistive coil; and leads for connecting the resistive coil to the power connecting unit at respective ends of the heater.

2. The fusing device of claim 1, wherein each of the first and second insulation layers is formed of at least one mica layer.

3. The fusing device of claim 1, wherein the power connecting unit comprises:

an electrode inserted into an outer end portion of each of first and second end caps which are installed at respective ends of the fusing roller and on an axis of rotation thereof;

a brush installed in a through hole formed in a frame supporting the fusing roller so as to contact the electrode; and elastic means for making the brush closely contact the electrode for electrical connection.

4. The fusing device of claim 3, wherein each of the first and second end caps comprises:

a lead hole formed in a lengthwise direction so as to allow each lead to pass therethrough; and a bottom portion formed so as to allow said each lead passing through the lead hole to be electrically connected to the electrode which is inserted into the corresponding end cap.

5. The fusing device of claim 4, further comprising:

a first insulation film provided on the bottom portion of each of the first and second end caps so as to isolate the bottom portion from the lead; and a heat sink provided on the first insulation film so as to be electrically connected to the lead.

6. The fusing device of claim 4, further comprising a second insulation film formed in the lead hole of each of the first and second end caps for isolating the lead from the lead hole.

7. The fusing device of claim 3, further comprising:

at least one key formed at a portion of an outer circumference of each of said first and second end caps, the portion engaging an end of the fusing roller; and at least one key way formed at each of said respective ends of the fusing roller so as to correspond to said at least one key.

8. The fusing device of claim 7, wherein said at least one key way is formed at an inner side of each of said respective ends of the fusing roller so as to be recessed.

9. The fusing device of claim 1, wherein each of said leads comprises:

a ring electrically connected to the resistive coil at respective ends of the heater; and a string extending from the ring.

10. A fusing device for an electrophotographic image forming apparatus, the fusing device comprising:

a heat pipe having a tubular shape and two ends, and containing a predetermined amount of working fluid, the heat pipe being hermetically sealed at both of said ends;

a fusing roller surrounding the heat pipe;

a heater installed between the fusing roller and the heat pipe for generating heat; and a power connecting unit for transmitting external electric power to the heater;

wherein the power connecting unit comprises:

an electrode inserted into an outer end portion of each of first and second end caps which are installed at respective ends of the fusing roller and on an axis of rotation thereof;

a brush installed in a through hole formed in a frame supporting the fusing roller so as to contact the electrode; and elastic means for making the brush closely contact the electrode for electrical connection.

11. The fusing device of claim 10, wherein each of the first and second end caps comprises:

a lead hole formed in a lengthwise direction so as to allow at least one lead to pass therethrough; and a bottom portion formed so as to allow said at least one lead passing through the lead hole to be electrically connected to the electrode which is inserted into the corresponding end cap.

12. The fusing device of claim 11, further comprising:

a first insulation film provided on the bottom portion of each of the first and second end caps so as to isolate the bottom portion from said at least one lead; and a heat sink provided on the first insulation film so as to be electrically connected to said at least one lead.

13. The fusing device of claim 11, further comprising a second insulation film formed in the lead hole of each of the first and second end caps for isolating said at least one lead from the lead hole.

14. The fusing device of claim 10, further comprising:

at least one key formed at a portion of an outer circumference of each of said first and second end caps, the portion engaging an end of the fusing roller; and at least one key way formed at each of said respective ends of the fusing roller so as to correspond to said at least one key.

15. The fusing device of claim 14, wherein said at least one key way is formed at an inner side of each of said respective ends of the fusing roller so as to be recessed.

16. The fusing device of claim 1, further comprising a plurality of leads, wherein each of said leads comprises:

a ring electrically connected to a resistive coil at respective ends of the heater; and a string extending from the ring.

17. A fusing device for an electrophotographic image forming apparatus, the fusing device comprising:

a heat pipe having a tubular shape and two ends, and containing a predetermined amount of working fluid, the heat pipe being hermetically sealed at both of said ends;

a fusing roller surrounding the heat pipe;

a heater installed between the fusing roller and the heat pipe for generating heat; and a power connecting unit for transmitting external electric power to the heater;

wherein the heater comprises:

a resistive coil for generating heat using the electric power transmitted by the power connecting unit, the resistive coil not being covered with a protective coating layer; and leads for connecting the resistive coil to the power connecting unit at respective ends of the heater;

wherein each of said leads comprises:

a ring electrically connected to the resistive coil at respective ends of the heater; and a string extending from the ring.

18. The fusing device of claim 17, wherein the power connecting unit comprises:

an electrode inserted into an outer end portion of each of first and second end caps which are installed at respective ends of the fusing roller and on an axis of rotation thereof;

a brush installed in a through hole formed in a frame supporting the fusing roller so as to contact the electrode; and elastic means for making the brush closely contact the electrode for electrical connection.

19. The fusing device of claim 18, wherein each of the first and second end caps comprises:

a lead hole formed in a lengthwise direction so as to allow each lead to pass therethrough; and a bottom portion formed so as to allow said each lead passing through the lead hole to be electrically connected to the electrode which is inserted into the corresponding end cap.

20. The fusing device of claim 19, further comprising:

a first insulation film provided on the bottom portion of each of the first and second end caps so as to isolate the bottom portion from the lead; and a heat sink provided on the first insulation film so as to be electrically connected to the lead.

21. The fusing device of claim 19, further comprising a second insulation film formed in the lead hole of each of the first and second end caps for isolating the lead from the lead hole.

22. The fusing device of claim 18, further comprising:

at least one key formed at a portion of an outer circumference of each of said first and second end caps, the portion engaging an end of the fusing roller; and at least one key way formed at each of said respective ends of the fusing roller so as to correspond to said at least one key.

23. The fusing device of claim 22, wherein said at least one key way is formed atan inner side of each of said respective ends of the fusing roller so as to be recessed.

* * * * *